US010578413B1

(12) United States Patent
Burke

(10) Patent No.: US 10,578,413 B1
(45) Date of Patent: Mar. 3, 2020

(54) BULLET PROJECTILE WITH INTERNAL ELECTRO-MECHANICAL ACTION PRODUCING COMBUSTION FOR WARFARE

(71) Applicant: Douglas Burke, Newport Beach, CA (US)

(72) Inventor: Douglas Burke, Newport Beach, CA (US)

(73) Assignee: Douglas Burke, Newport Beach, CA (US)

( * ) Notice: Subject to any disclaimer, the term of this patent is extended or adjusted under 35 U.S.C. 154(b) by 0 days.

(21) Appl. No.: 15/731,556

(22) Filed: Jun. 23, 2017

(51) Int. Cl.

| | |
|---|---|
| ***F42B 12/74*** | (2006.01) |
| ***F42C 11/04*** | (2006.01) |
| ***B21K 21/06*** | (2006.01) |
| ***F42B 12/06*** | (2006.01) |
| ***F42B 12/34*** | (2006.01) |
| *B21K 1/02* | (2006.01) |

(52) U.S. Cl.
CPC ..... *F42C 11/04* (2013.01); *B21K 21/06* (2013.01); *F42B 12/06* (2013.01); *F42B 12/34* (2013.01); *F42B 12/74* (2013.01); *B21K 1/025* (2013.01)

(58) Field of Classification Search
CPC ..... F42B 12/06; F42B 12/02; F42B 12/04; F42B 12/20; F42B 12/204; F42B 12/207; F42C 11/04
See application file for complete search history.

(56) References Cited

U.S. PATENT DOCUMENTS

| | | | | |
|---|---|---|---|---|
| 726,291 | A | 4/1903 | Holmblad | |
| 1,755,023 | A * | 4/1930 | Ruhlemann | F42C 11/00 102/209 |
| 4,065,753 | A * | 12/1977 | Paul, Jr. | A01K 11/006 102/501 |
| 4,207,796 | A * | 6/1980 | Warnock | F41A 19/63 102/202 |
| 4,372,214 | A * | 2/1983 | Toton | F42B 1/00 102/305 |
| 4,482,107 | A * | 11/1984 | Metz | F42B 10/663 239/265.19 |
| 6,679,179 | B1 * | 1/2004 | Bohl | F41H 13/0093 102/210 |
| 6,845,718 | B2 * | 1/2005 | Fortner | F41B 6/006 102/489 |
| 7,173,540 | B2 * | 2/2007 | Daigle | F42B 8/26 102/209 |
| 7,624,682 | B2 * | 12/2009 | Lloyd | F42B 12/06 102/497 |
| 2018/0038675 | A1 * | 2/2018 | Graswald | F42C 19/0838 |

OTHER PUBLICATIONS https://en.wikipedia.org/wiki/High-explosive incendiary armorpiercing ammunition.

* cited by examiner

*Primary Examiner* — Joshua T Semick

(57) ABSTRACT

A bullet projectile is described with an internal magnetic hammer providing electromagnetic induction upon impact.

15 Claims, 16 Drawing Sheets

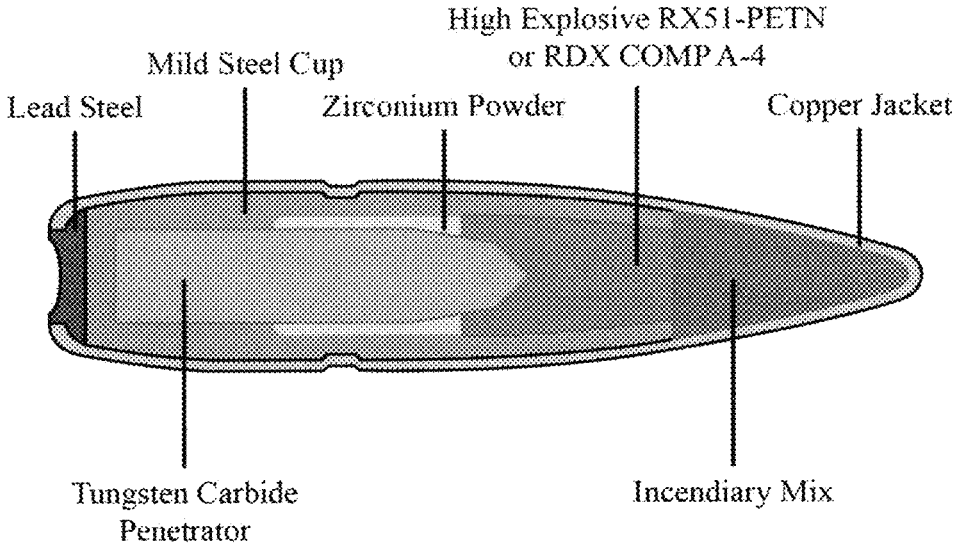
Figure 0. (PRIOR ART)
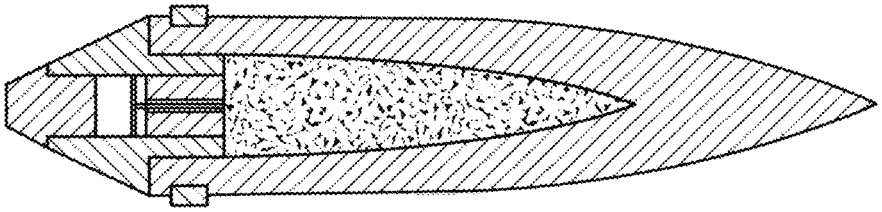
Figure 0-a. (PRIOR ART)

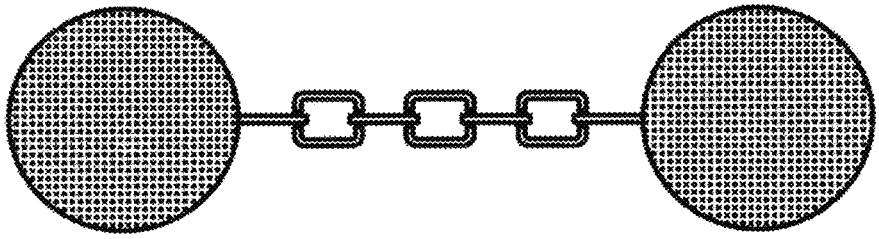
Figure 0-b. (PRIOR ART)

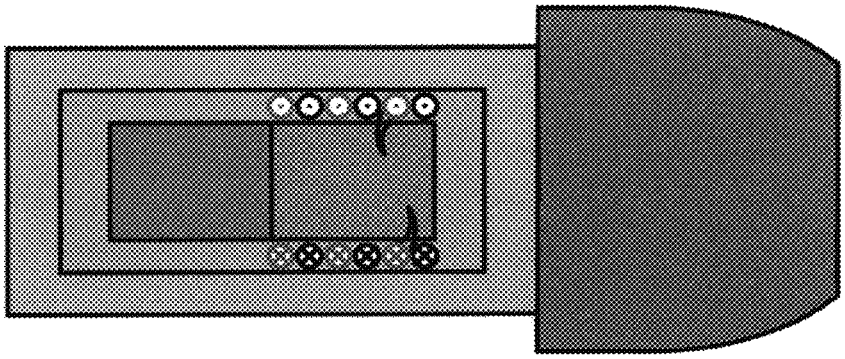
Figure 16-a.
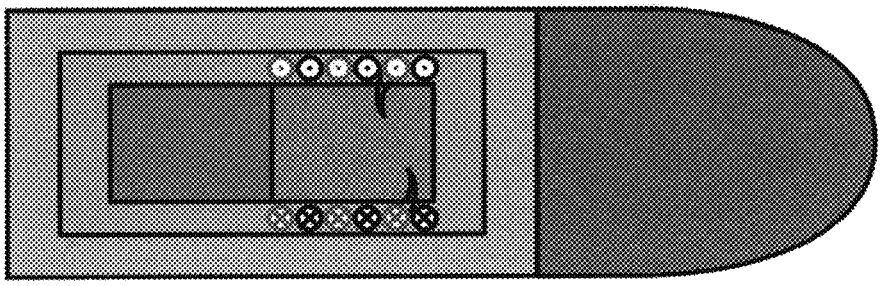
Figure 17.

BULLET PROJECTILE WITH INTERNAL ELECTRO-MECHANICAL ACTION PRODUCING COMBUSTION FOR WARFARE

BACKGROUND OF THE INVENTION

The proposed invention is in the field of bullets and projectiles for warfare. In its basic mode it is related to double impact bullet systems. This invention is a formal application based on the provisional application No. 62/392,902 previously filed 14 Jul. 2016. In the claimed mode of operation of this invention, it is related to bullet systems that explode on impact with the target.

In the prior art a good description for a modem exploding bullet is given on Wikipedia and that example is used here with a different description than is on Wikipedia. Nonetheless the basic elements of the prior art can be taught and explained with this example. (One can find all of this by searching the words High explosive incendiary armor piercing ammunition on Wikipedia.)

High-explosive incendiary/armor-piercing ammunition (HEIAP) is a form of shell which combines armor-piercing capability and a high-explosive effect. In this respect, it is a modern version of an armor-piercing shell.

Typical of a modern HEIAP shell is the Raufoss Mk 211 .50 BMG round designed for weapons such as heavy machine guns and anti-materiel rifles. This round is pictured in FIG. 0. It is as good an example to use as any other since all these exploding bullets have the same basic elements.

The Raufoss Mk 211 is a .50 caliber (12.7×99 mm NATO) multipurpose anti-materiel projectile produced by Nammo (Nordic Ammunition Group, a Norwegian/Finnish military industry manufacturer of ammunition), under the model name NM140 MP. It is commonly referred to as simply multipurpose or Raufoss, which refers to Nammo's original parent company: Raufoss Ammunisjonsfabrikker(Ammunition Factory) in Raufoss, Norway, established in 1896. The "Mk 211" name comes from the nomenclature "Mk 211 Mod 0" used by the U.S. military for this round.

Due to its popularity, several U.S. arms manufacturers produce the round under license from NAMMO Raufoss AS. There is also a tracer variant, the MK300, used in the Browning heavy machine gun.

The primary purpose of these munitions is armor penetration, HEIAP munitions use high explosives to "blast a path" for the penetrator. Referring to FIG. 1 we can see that within the copper jacket there are several parts which communicate mechanically and chemically upon impact. As the bullet hits the target the target offers resistance in the form of friction upon deceleration. The friction between the bullet and the object it hits causes the incendiary material in the nose of the bullet to ignite which in turn ignites the high explosive material. The high explosive material can be HMX,RX51-PETN, RDX COMP A-4, or any of the plastic explosives which have the chemistry to internally explode without the need for an external oxygen source. When the high explosive material explodes, the explosion is supposed to blast a path for the tungsten carbide penetrator which then can continue on through the material out of which the target is made. The zirconium powder is an additional material that continues to burn after the explosion perhaps to cause damage to flesh and bone etc. . . . . The MK 211 is claimed to penetrate up to two inches (51 mm) of rolled homogeneous armor.

The triggering of the explosive charge is dependent upon the resistance of the target. If the target offers little resistance then the lack of frictional heating will prevent the incendiary from igniting and the high explosive from detonating.

Also referring to FIG. 0*a* is an early version of an exploding bullet to Holmblad 8 Aug. 1900 U.S. Pat. No. 726,291. This has initial impact upon collision and secondary shock waves due to its explosion. An even earlier version of a multiple impact bullet would be the tethered musket balls or cannon balls referred to in FIG. 0*b*. These were used to impart damage to ships rigging and masts.

The proposed invention is a novel double impact bullet with an internal magnetic hammer that delivers a mechanical kinetic phenomenon superior to previous double or multiple impact systems. However, being a magnet, the invention further includes a concentric cylindrical coil the ends at which are generated a high voltage spark discharge capable of detonating even the most stubborn of explosive materials thus creating a very substantial exploding bullet. The internal hammer kinetic action of the proposed invention within the body of the bullet is absent in the prior art and is the reason for the advantages of the proposed invention. Further the internal electromagnetic induction features of the proposed invention further describe the novelty of this invention. A specific example from physics will describe some background terms which will aid in the description of the invention. A wire wound in a cylindrical coil has an electrical property called inductance The inductance of the coil is the magnetic permeability of the material within the coil times the number of turns squared times the cross sectional area of the coil divided by the length of the coil. If a permanent magnetic is moved into the coil the magnetic flux through the inside of the coil will change with time and a voltage will appear across the two ends of the wire and a current will appear in the wire. The electrical stored in the inductor when there is a voltage between the ends of the wire is equal to one half times the inductance times the square of the current.

BRIEF DESCRIPTION OF THE DRAWINGS

FIG. 0 Modern exploding bullet design with penetrator

FIG. 0*a* Exploding bullet of Holmblad from 1900

FIG. 0*b* Tethered musket balls for double impact

OBJECTS AND ADVANTAGES (1) The proposed invention is an improved double impact exploding bullet.

(2) The proposed invention only requires deceleration to detonate. It does not require a high friction impact with target to explode.

(3) The proposed invention does not require an incendiary load. The space not used up for the incendiary material can be used to increase the amount of high explosive material.

(4) The proposed invention can be used with a high explosive material that is very difficult to ignite by conventional means.

(5) In one of its modes the proposed invention can be used to generate a spherical shock wave of extremely high pressure to further the damage to armor beyond what was previously possible.

(6) The proposed invention does not require an internal electric power source.

(7) When sitting or when being shipped the proposed invention can be made so that the chance of accidental explosion is removed.

DETAILED DESCRIPTION OF THE INVENTION

The invention has many modes and they will be described in an order that teaches the reader the essence of the technology. In all the modes of the proposed invention it is assumed that the reader is skilled in the art and that it is obvious how to get the projectile into flight from an explosive gun powder or its equivalent in a firearm. It is also assumed that a full metal copper jacket would cover each of the structures shown in all of the modes of the invention. The full metal copper jacket is left out of the description and is absent from the drawings. Terminology from rocketry science is used since it seems like the terms are a natural way to describe the technology. These terms are specific to the proposed invention and their meanings are not identical to the way they are used in rocketry but they are however close. For example a nose cone in rocketry is a separate and distinct embodiment from the fuselage but for the proposed invention they may be considered a single embodiment depending on whether they are made of different materials.

It is further noted that there is a co-pending application filed on the same day as this application which is a strictly mechanical projectile with internal electromagnetic induction being absent. The description of the content of that specification is repeated here because the details in that description is necessary background for understanding the present invention.

Figure 1:
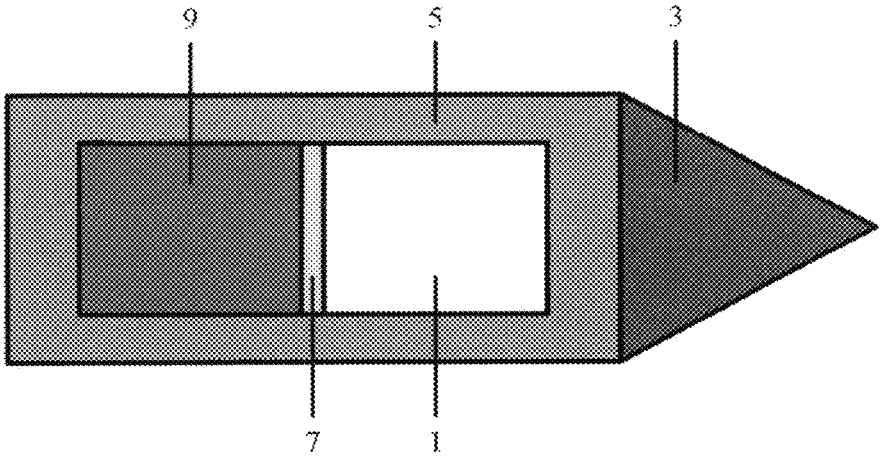
FIG. 1 Projectile with mechanical features shown and pointed nose cone

Referring to FIG. 1 what is shown are the basic embodiments of the mechanical mode of the proposed invention. This mode is claimed in a co-pending application and its description is repeated here to make the electromechanical action of the present invention easier to understand. Again, referring to FIG. 1 this mode consists of an empty internal space (1), a nose cone (3), a fuselage (5), a Hammer retaining mass spacer (7), and an internal Hammer (9). The hammer is inherently internal and will be referred to as the hammer without further use of the adjective internal. The operation of this mode comprises the following. After the bullet is in flight it will fly towards its target. Upon impact with the target the nose cone and fuselage will experience a shock wave of first mechanical impact. Because of Newton's second law, due to the deceleration of the center of mass of the system the hammer will be forced forward towards the nose cone. As the hammer is forced forward the hammer retaining spacer is designed to break and allow the hammer to move forward within the fuselage. Alternatively, the hammer could be tethered to the rear of the fuselage. The tether would be a string which would break upon impact as the hammer is forced forward. The nose cone can be made large enough and massive enough to allow the hammer enough time to move through the fuselage before the fuselage suffered fracture which would immobilize the hammer. That is to say that upon first impact the nose cone would be designed to undergo a plastic deformation that would absorb the initial shock wave thereby protecting the fuselage from damage giving the hammer enough time to move through the interior of the fuselage. The hammer would thus be forced through the nose cone and into the target providing a secondary impact to the target. It is desirable that the hammer have more mass than the mass of the sum of the remaining parts. To achieve this end the nose cone would be made out of lead. The fuselage would be made out of ceramic. The hammer would be made out of Uranium. Depleted uranium would be fine since there is no advantage to it being not depleted. These choices of materials would allow the bullet to function upon impact. The desired mechanical effects are that the initial blow causes plastic deformation in the nose cone. The first shock wave is thus slowed down by the plastic deformation. The hammer is forced forward in the rigid structure of the fuselage. The hammer makes the secondary impact with the target. This mode of the proposed invention is thus a double impact bullet. The first impact serves to soften the target by way of kinetic energy being converted into heat. The second impact of the hammer serves to deliver the penetrating blow to the target. The hammer itself is a solid cylinder. Like all solid cylinders it has a length and a diameter. The hammer has specific mechanical communication with the fuselage. The length of the hammer is an important parameter and such we shall refer to its length at times as $L_H$. The L indicating length and the subscript H indicating hammer. The fuselage is also a cylinder. It is different from the hammer in that it is not a solid cylinder. The fuselage is a hollow cylinder. There for it has walls with a defined thickness. The perpendicular cross section of all hollow cylinders defines two concentric circles. The inner circle has a diameter which we shall refer to as the inner diameter. The outer circle has a diameter which we shall refer to as the outer diameter. The wall thickness of all hollow cylinders is one half of the outer diameter minus one half of the inner diameter. The fuselage in this invention is indeed a hollow cylinder an it has a length. The length of the fuselage is an important parameter and such we shall refer to its length at times as ($L_F$). The L indicating length and the subscript F indicating fuselage.

Furthermore, the fuselage is a hollow cylinder and so has an inner diameter and an outer diameter. In describing this invention and in the language of the claims we may refer to the inner diameter of the fuselage as (ID) and the outer diameter of the fuselage as (OD). Since the hammer has to slide within said fuselage and the fuselage has closed ends it is obvious by conservation of space that the length of the hammer must be less than the length of said fuselage. In the notation now defined this can also be worded with phrases like "the hammer having a length less than ($L_F$)" which will have the meaning that the length of the hammer is less than the length of the fuselage as it must be if it is to be able to move within the hollow enclosure defined by the fuselage which is a hollow cylinder. It should als be noted that the hammer will slide within the fuselage and so must have a diameter that is less than the (ID) of the fuselage. How much less is determined by the standard machining practices as defined in, the machining handbooks. For the purposes of the invention the diameter of the hammer should be between one and 10 mils. A mil being a thousandth of an inch.

Figure 2:
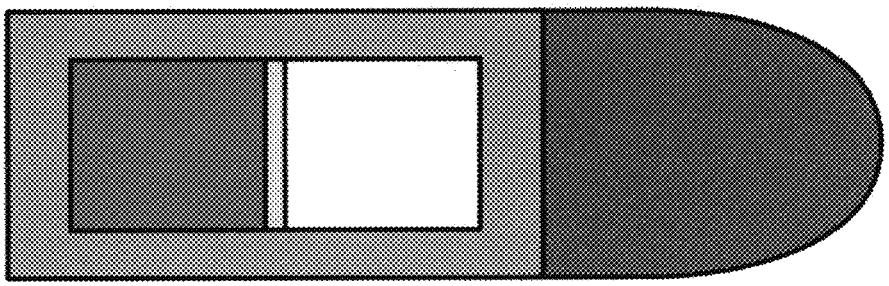
FIG. 2 Projectile with mechanical features shown and rounded nose cone
Figure 3:
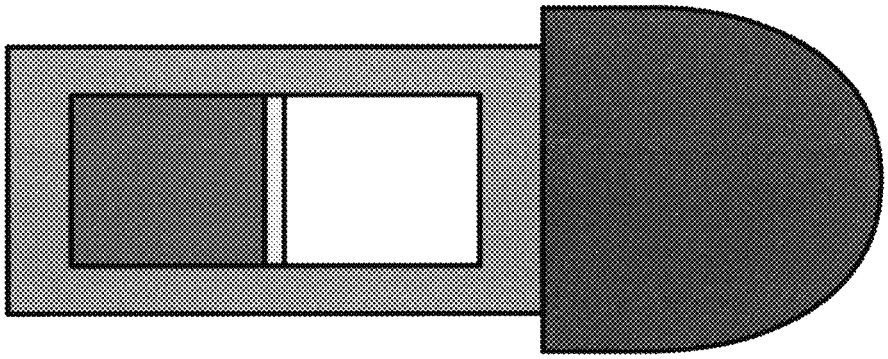
FIG. 3 Projectile with mechanical features shown and oversized rounded nose cone FIG. 4 Projectile with mechanical features shown and oversized flat nose cone FIG. 5 Design with additional exterior fuselage and pointed nose cone FIG. 6 Design with additional exterior fuselage and rounded nose cone FIG. 7 Design with additional exterior fuselage and rounded oversized nose cone FIG. 8 Design with additional exterior fuselage and flat oversized nose cone FIG. 9 Design with magnetic hammer, and explosive material, and electromagnetic coil for generating high voltage FIG. 10 Schematic showing electromagnetic induction happening on impact FIG. 11 Standard mechanical design with explosive material FIG. 12 Standard mechanical design with explosive material and the changing of the hammer to a magnetic material giving it a north and south pole FIG. 13 Electromagnetic design with internal shot and or shrapnel included and rounded nose cone FIG. 14 Electromagnetic design with internal shot and or shrapnel included and oversized flat nose cone FIGS. 15-23 Electromagnetic designs with additional exterior fuselage and different fuselage and nose cone geometries FIG. 24 Schematic of induction circuit with diode included FIG. 25 Electromagnetic design with compound nose cone

Referring to FIG. 2 what is shown is another version of the mechanical mode of the invention with all the same basic elements as those found in FIG. 1. The only difference is that there is a geometric difference in the design of the nose cone. Thus all the adjustments in shape that are made in bullets in general can be made to the bullet projectiles of the proposed invention Referring to FIG. 3 what is shown is another version of the mechanical mode of the invention with all the same basic elements as those found in FIG. 1. The only difference is that there is a geometric difference in the design of the nose cone. Here the nose cone has a larger diameter than the fuselage. In this design, the nose cone is designed to have more mass than the hammer and the remaining parts. This bullet looks more like a dart. The advantage to this design of mode one of the proposed invention is that it is less likely to ricochet off the target before the hammer engages. The hammer is Uranium and it is not involved in the first impact directly. The nose cone is made of lead which has a relatively low specific heat. The nose is relatively flat so the bullet is not designed to penetrate. The nose cone will however get relatively hot on impact and deform around the sides of the fuselage. This will spread kinetic energy around the fuselage and protect it from getting damaged so there is time for the hammer to move inside the fuselage and deliver the secondary impact.

If the fuselage gets damaged before the hammer slides forward the effectiveness of the hammer will be limited.

Figure 4:
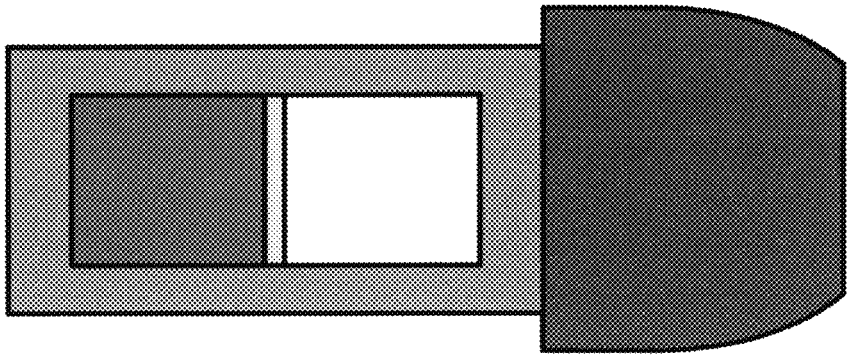

The heating of the nose cone on impact can be further enhanced by the design shown in FIG. 4. Referring to FIG. 4 the flattening of the nose cone will further reduce the penetration depth and speed up the loss of kinetic energy of the projectile and its corresponding conversion into heat. Heat that will raise the temperature of the nose cone and deform it around the fuselage.

Figure 5:
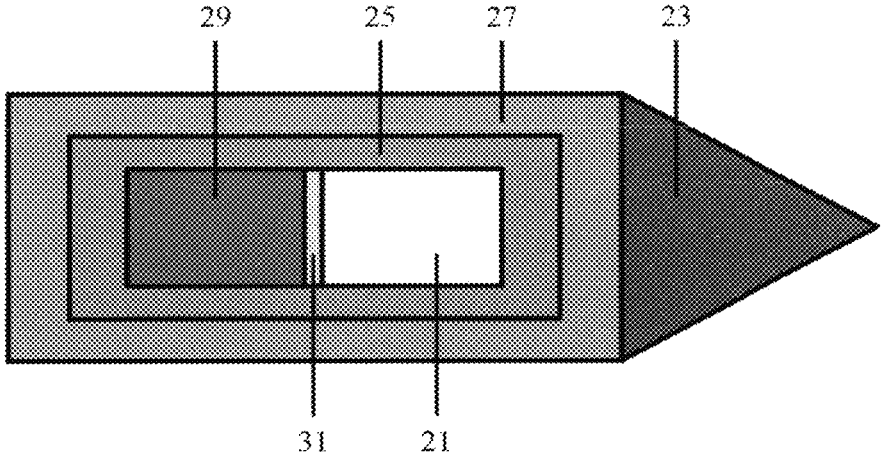

Another design of mode one of the proposed inventions can be found in FIG. 5. Referring to FIG. 5 what is shown is an empty internal space (21), a nose cone (23), an inner fuselage (25), an outer fuselage (27), an internal Hammer (29), and a Hammer retaining mass spacer (31). The advantage of this design is that the outer fuselage further protects the structural integrity of the inner fuselage. A choice of materials would be: Inner fuselage should be made of ceramic or a very stiff metal like Beryllium or spring steel. These materials are known to be stiff which means they have a high Young's modulus. The Young's modulus of a typical ceramic like Alumina is around 360 GPa. Silicon Carbide has a young's modulus of 440 Gpa. The Young's modulus of Beryllium is between 275 and 315 Gpa depending on how it Is annealed. The Young's modulus of a typical Spring Steel like ASTM A227 spring steel is around 190 Gpa. The hardness of ceramics ranges from 10 to 50 Gpa which is equivalent to between 10,000 and 50,000 Mpa. The outer fuselage should be made of copper or lead. The nose cone should be made of copper or lead. The Young's Modulus of Copper is between 121 and 133 Gpa depending on how it is annealed. The Young's Modulus of lead is between 13 and 15 Gpa depending on how it is annealed. The Hammer should be made of Uranium or Tungsten or a high-density alloy. The density of Uranium 19 g/cm$^3$. The Young's modulus of Uranium is between 174 and 178 Gpa depending on how it is annealed. The hardness of Uranium is between 1850 and 2750 Mpa depending on how it is annealed. The density of Tungsten is 19.25 g/cm$^3$. The Young's modulus of Tungsten is between 340 and 405 Gpa depending on how it is annealed. The hardness of Tungsten is between 4500 and 8500 Mpa depending on how it is annealed. The hardness of a material is measured as the force per area that the surface can withstand before it suffers a minimum indentation.

Figure 6:
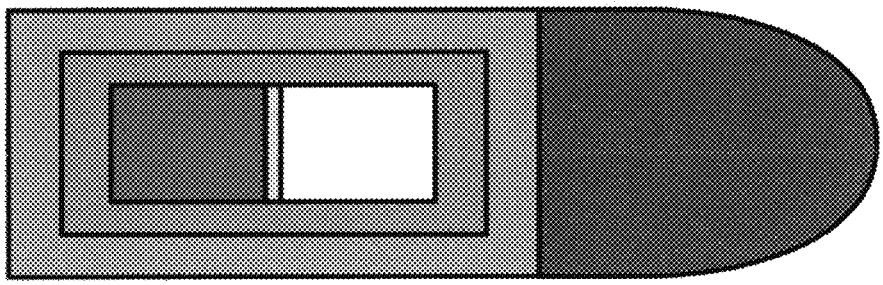
Figure 7:
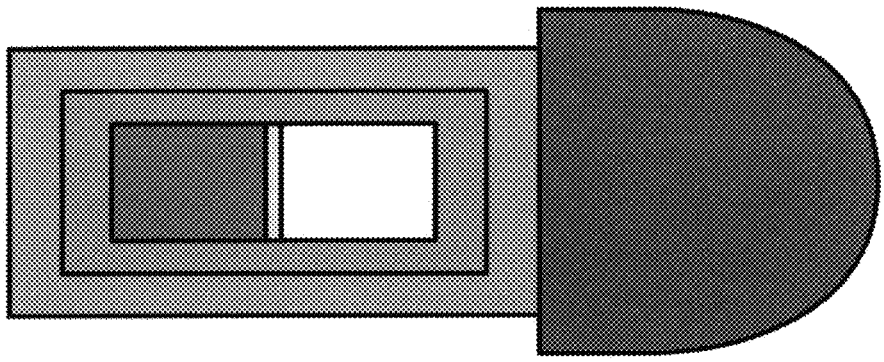
Figure 8:
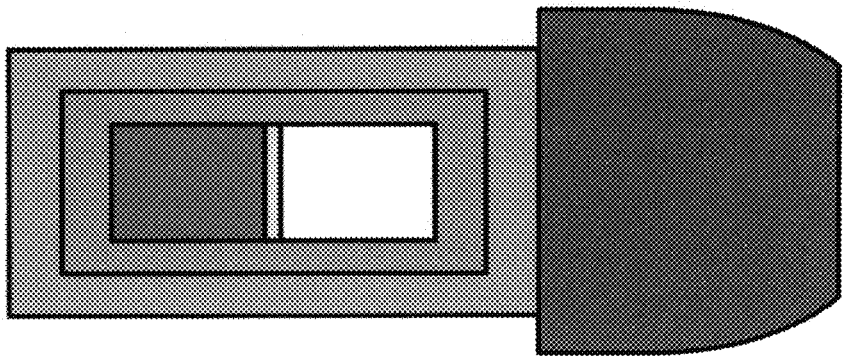

Referring to FIGS. 6, 7, &8 what is shown are different nose cone designs on the double fuselage design of FIG. 5. These nose cone designs have the advantages already cited earlier.

The fully operational mode which is the mode claimed in the proposed invention that is to follow is the electromagnetic electromechanical mode. All the features discussed above and referred to in FIGS. 1-8 can be incorporated into the design of the electromagnetic electromechanical mode.

Figure 9:
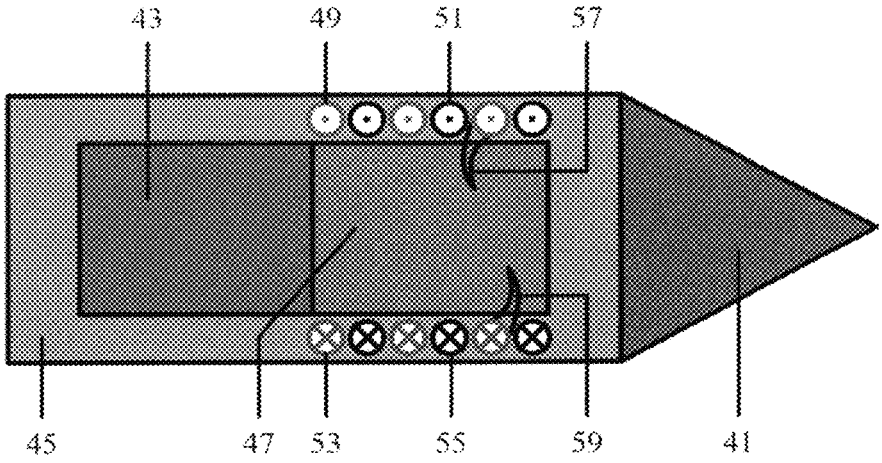

The electromagnetic electromechanical mode of the proposed invention is a novel design of a bullet that explodes on impact. Referring to FIG. 9 what is shown are the basic embodiments of this operational mode of the proposed invention. It consists of a nose cone (41), a fuselage (43), an internal Hammer made of a material which has a permanent aligned magnetic moment (45), a region packed with explosive material (47), a wire embedded within the cylindrical fuselage and wrapped with cylindrical symmetry surrounding the region packed with explosive material (49), (51), (53), (55), as the wire moves in a contiguous path in a circle around the cylindrical fuselage that portion of the wire that would move out of and into the plane of the page as represented by (49) & (51) which are symbolic representations of a tip of an arrow pointing out of the plane of the page, as the wire moves in a contiguous path in a circle around the cylindrical fuselage that portion of the wire that would move into the plane of the page is represented by (53) & (55) which are symbolic representations of a tail of an arrow pointing into the plane of the page, and one end of said cylindrical wire terminating in a sharp point and embedded in said explosive material (57), the opposite remaining end of said cylindrical wire terminating in a sharp point and embedded in said explosive material (59), said two opposing ends of wire terminating in sharp points being positioned facing each other and in close proximity of each other. Referring to FIG. 9, as said wire wraps around the inner radius of said fuselage that portion of the wire that is traversing from right to left is color coded in black (51) & (55), and that portion of the wire that is traversing from left to right is color coded in blue (49) & (53).

Figure 10:
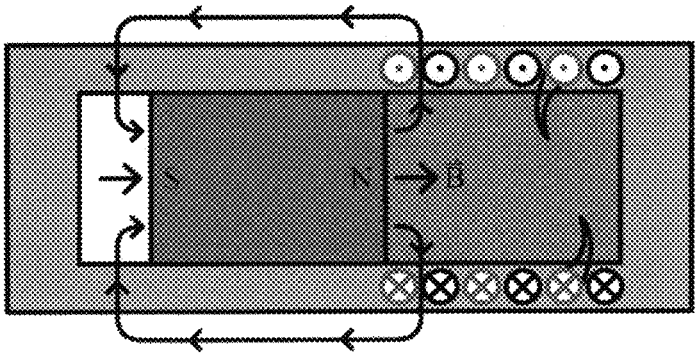

The operation of the second mode of the proposed invention is explained as follows. Upon impact with the target the bullet system decelerates and the internal Hammer is forced forward into the explosive material. Referring to FIG. 10 what is shown is the magnetic polarity of the Hammer, said Hammer being a permanent magnet in the requirements cited above. As can be seen in FIG. 10 the right side of the Hammer is labeled with an N indicating the north pole of its magnetic moment and the left side of the Hammer is labeled with an S indicating the south pole of its magnetic moment. The magnetic field lines, B, of the Hammer emanate from the North Pole and wrap around into the South Pole as shown in the drawing. Thus as the Hammer moves into the explosive material it is creating a time changing magnetic flux through the geometric interior of the cylindrical coil. This time changing magnetic flux will induce a voltage between the wire termination points (57) & (59) in FIG. 9, according to Faraday's Law of electromagnetic induction. The sudden impact of the bullet will force the Hammer Magnet through the coil in less than a millisecond making the time derivative of the Magnetic Flux very large. If the Hammer is made of 80 percent depleted Uranium and 20 percent Neodymium—Nickel-Boron (a permanent magnetic material with a large magnetic moment per unit volume) the voltage between the wire termination points (57) & (59) in FIG. 9, can be made to be well into the several kilovolt range with a modest number of turns on the coil. This will create a high discharge between the wire termination points (57) & (59) in FIG. 9. Thus, the action of the Hammer moving through the coil acts as a spark detonator for the explosive material (47) in FIG. 9. This spark detonating action represents the internal combustion aspects of the invention in this mode of operation. The actual voltage generated between the wire termination points (57) & (59) in FIG. 9 is proportional to the number of turns in the coil n times the cross sectional area of the coil A times the derivative of the magnetic field with respect time, $\delta B/\delta T$, within the coil. The number of turns n can be adjusted to accommodate needs of high voltage. The geometry of the nose cone and the choice of material of the nose cone can make the bullet stop very quickly in the target making the derivative of the magnetic field with respect time within the coil larger or smaller (by way of adjusting $\delta T$) to allow another method of adjusting the voltage output at the wire termination ends to accommodate needs of high voltage. The magnetic moment per unit volume within the material of the Hammer can be adjusted by choice of materials out of which the Hammer is made. This makes the actual magnetic field of the Hammer just beyond its ends larger or smaller. This allow another method of adjusting the voltage output at the wire termination end to accommodate needs of high voltage (by way of adjusting $\delta B$). The exploding bullet system of the proposed invention is superior to the prior art in the background section for many reasons. One in particular is that the explosion is more precisely directed forward towards the target and the explosion can be accelerated to happen more quickly and is thus more violent.

The spark detonation eliminates the need of a primary and secondary explosive. In plastic explosive technology, a primary incendiary explosive is often used to detonate the secondary more powerful explosive material. This allows the entire volume of the interior cavity of the fuselage dedicated to explosive material to be allocated to the high explosive material so no volume is wasted on a detonating explosive material. For use in this proposed invention a reliable explosive with a relative effectiveness factor of 1.66 (relative energy per unit volume of explosive compared to TNT) is Pentaerythritol Tetranitrate. This material will detonate with a spark detonator and will be very stable within the casing of the bullet. The explosive material can be selected from group consisting of those materials that are in the class of plastic explosives that do not require an oxygen source to explode and do require a spark detonation to explode.

Figure 11:
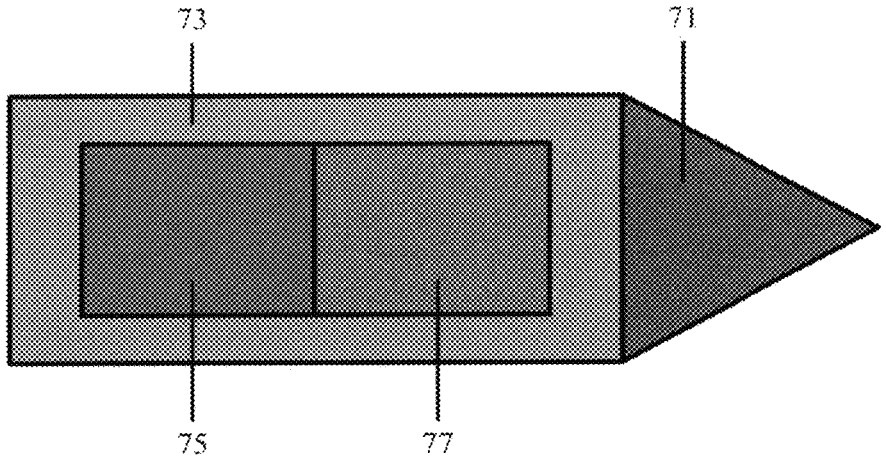

In actuality, there are many plastic explosives that simply require a mechanical shock wave to explode. These can be used in an exploding version of the bullet as shown in FIG. 11. This would be classified as strictly mechanical explosive mode of the proposed invention without spark detonation. Here the chemistry of the explosive material is chosen so that the mechanical shock caused by the Hammer forcing its way into the explosive material is enough mechanical energy to detonate the explosive material. This would be the version shown in FIG. 11. Referring to FIG. 11 what is shown is a bullet system comprising a nose cone (71), a fuselage (73), a Hammer (75), and an explosive material (77). The caveat here is that the explosive material here is selected from the group of plastic explosives that require a mechanical shock wave to detonate. Alternatively this version of the proposed invention could have the explosive material made out of a mixture of primary and secondary explosives. This version of the technology is claimed in my co-pending application titled "Bullet projectile with enhanced mechanical shock wave delivery for Warfare"

Figure 12:
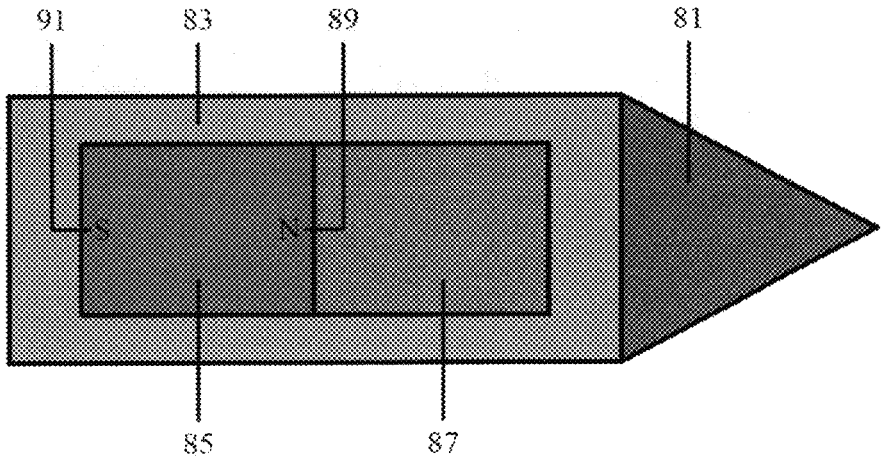

Another version of the proposed invention is shown in FIG. 12. Referring to FIG. 12 what is shown is a bullet system comprising a nose cone (81), a fuselage (83), a Hammer (85), an explosive material (87). In this version of mode two the Hammer is a permanent magnet with a North and a South end but the coil is absent in the fuselage. If the Hammer is made of a material with a large magnetic moment per unit volume and the bullet stops quickly enough upon hitting the target there will still be a large enough electric field generated by Faraday's Law to cause detonation even without the coil in the fuselage. These induced electric field will have cylindrical symmetry within the cylindrical volume of the explosive material. That is to say they will form circles around the cylindrical axis of the cylindrically symmetric volume of the explosive material. These electric fields can be made large enough to generate a high enough energy per volume to cause detonation throughout the volume of the explosive material.

Figure 13:
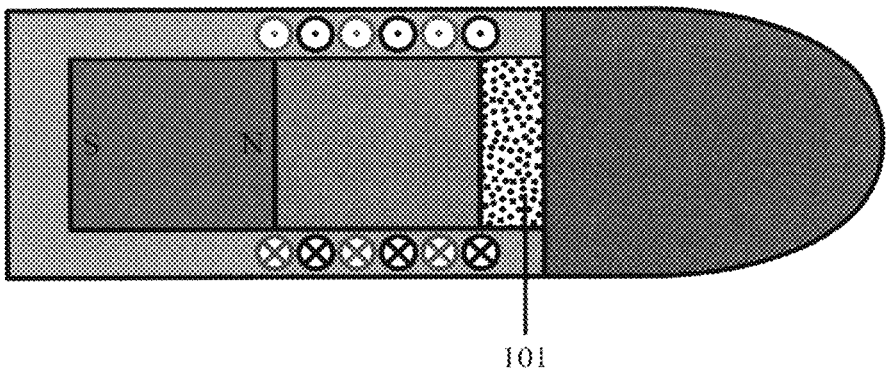

Another version of the mode two exploding bullet system is shown in FIG. 13. Referring to FIG. 13 what is shown is a spark detonating exploding bullet system with coil as discussed yet further including a couple of different design features. In particular the front end of the fuselage is absent as can be seen in FIG. 13. The other difference is that this system further includes a region (101) between the explosive material and the nose cone packed with shrapnel or the equivalent of buckshot. In this version, the nose cone would be made of an alloy material that would have a small specific heat and a low melting temperature so that upon impact it would become molten. The shrapnel would be made of a material with a high melting temperature and a very hard micro infrastructure like tungsten carbide, titanium carbide, or Beryllium Carbide. As the bullet makes impact, the hammer moves forward and the explosive material explodes. The explosion sends the molten nose cone and the shrapnel forward into the target.

Figure 14:
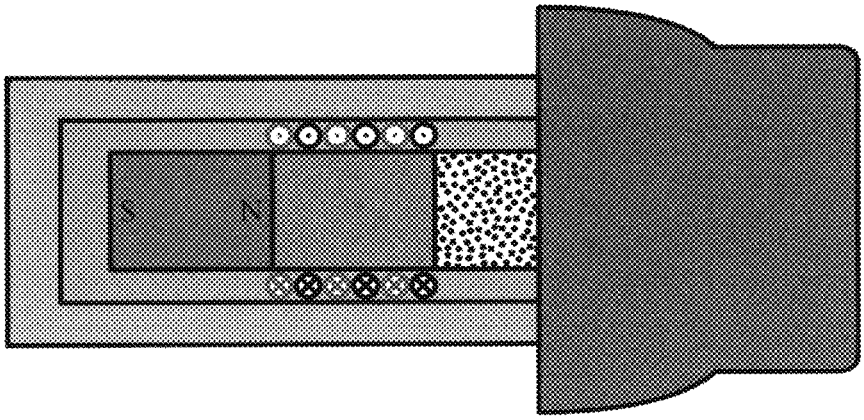
Figure 15:
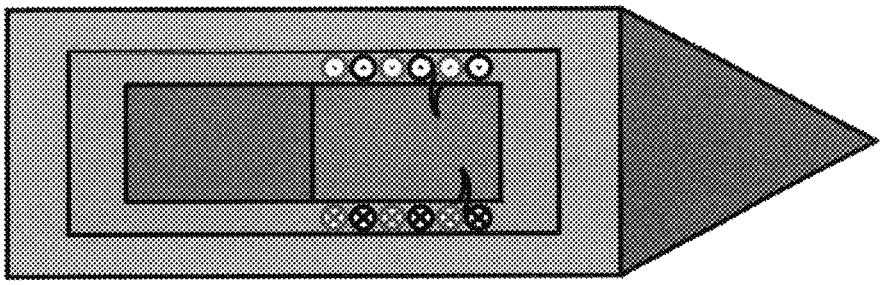
Figure 16:
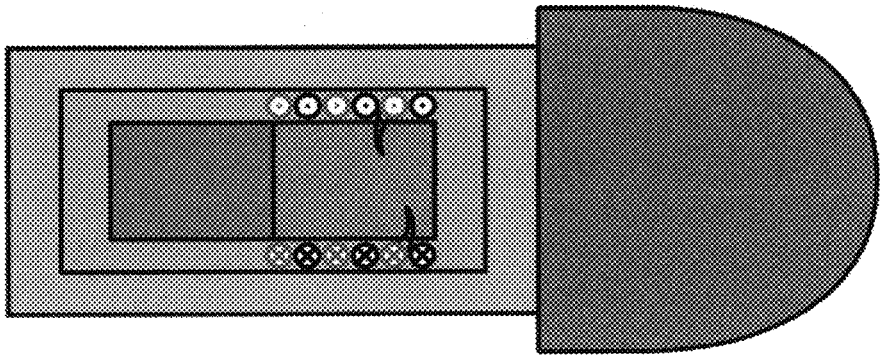
Figure 18:
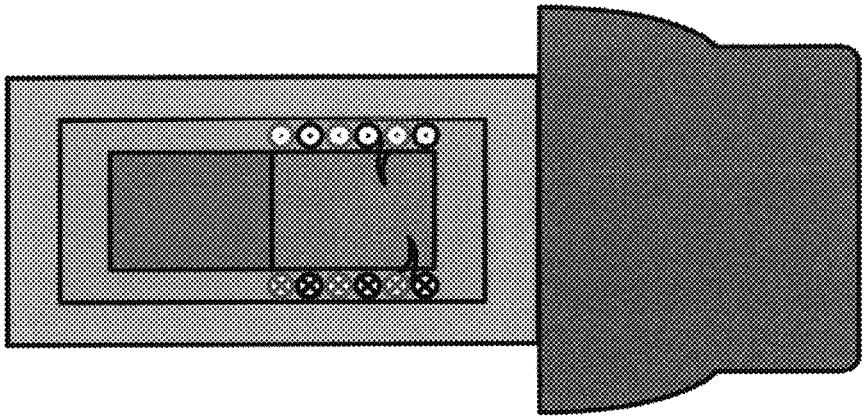
Figure 19:
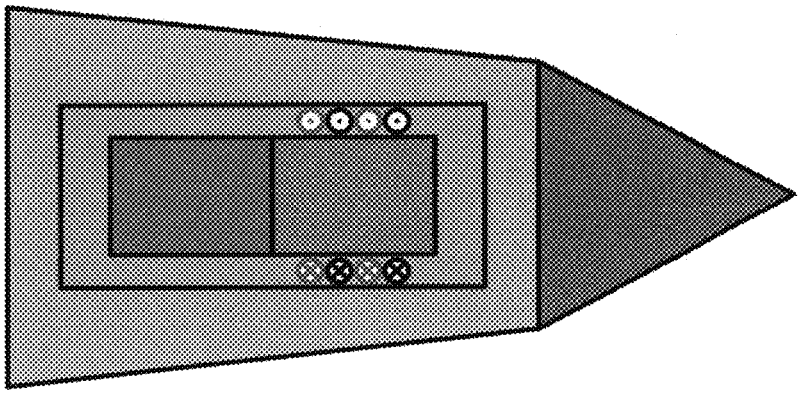
Figure 20:
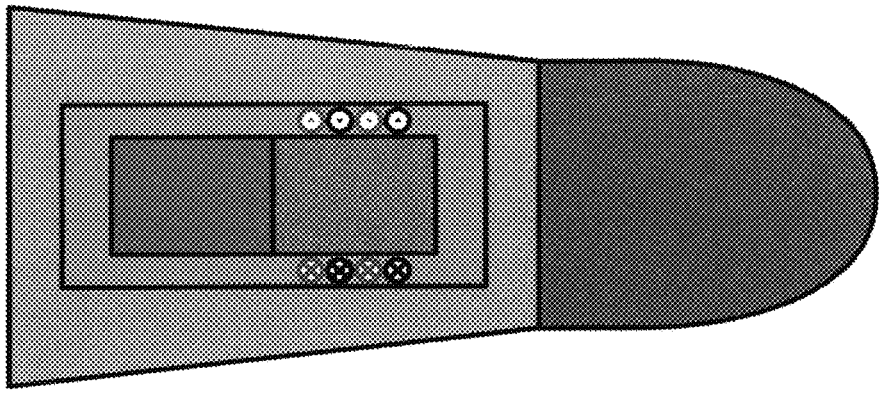
Figure 21:
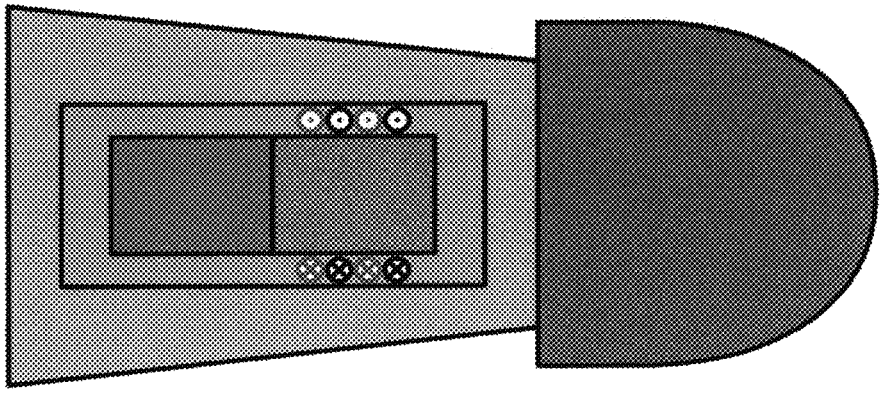
Figure 22:
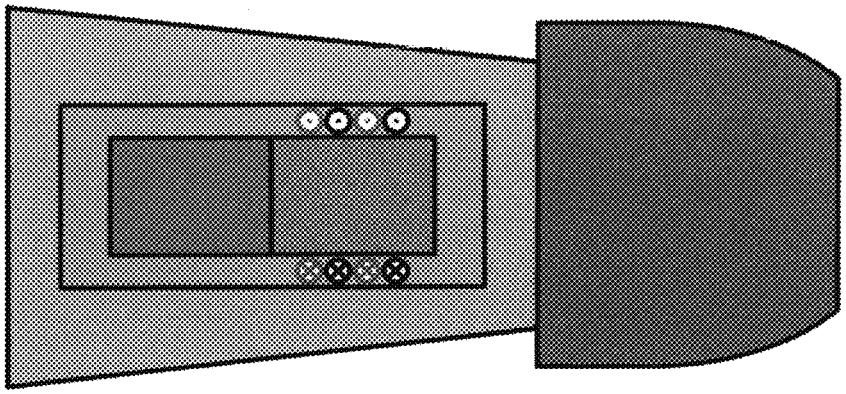
Figure 23:
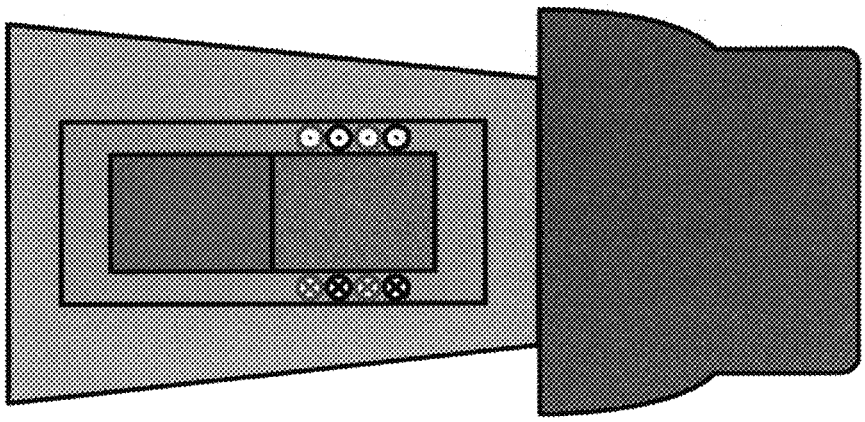

Referring to FIG. 14 what is shown is a version of a bullet system further including a shrapnel load and a different nose cone design with a double fuselage.

Other versions of the exploding bullet systems with coil spark detonation of mode two can incorporate the different geometric designs of inner and outer fuselages and the different geometric designs of the different nose cones. A plurality of these designs are shown in FIGS. 15 to 23.

Figure 25:
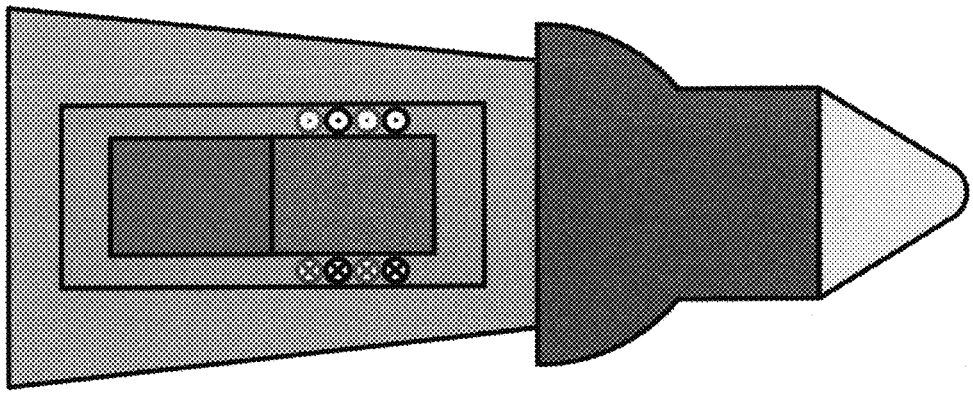

Yet another version of this electromechanical electromagnetic system is shown in FIG. 25. Referring to FIG. 25 what is shown is another version of mode two of the invention wherein the nose cone is double stage. The yellow tip of the nose cone is a material that is hard and has a high melting point so it penetrates. The blue or indigo second stage of the nose cone is a material like lead that will get hot and molten on impact. Then when the Hammer detonates the explosive there is an additional secondary penetrator which is the Hammer.

A general discussion of the electromagnetic theory of operation of the proposed bullet system gives rise to novel circuit features that are critical to the successful operation of the invention. These features are now discussed.

Figure 24:
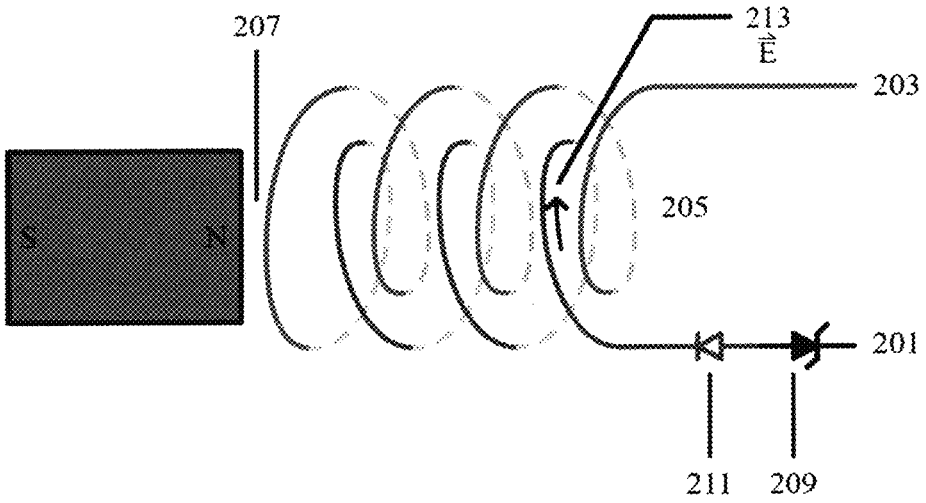

In the mode of the invention wherein the coil is present as a spark detonator a precautionary additional feature can be added. Referring to FIG. 24, imagine that the coil in FIG. 24 is the coil in the bullet system and the bullet system is travelling from left to right in the diagram. As the bullet strikes the target on the right hand side of FIG. 24 the Magnet Hammer moves into the coil from left to right entering the coil at position (207) in FIG. 24. In FIG. 24 the blue shaded part of the coil is traversing from right to left in the Figure, and the red shaded part of the coil is traversing from left to right in the figure. The dotted or dashed lines in the coil are behind the solid lines. Bearing this in mind if you look down the axis of the coil from position (205) in FIG. 24 you are looking from right towards the left in the Figure. So in FIG. 24 in looking down the axis of the coil through the coil from the point of view of position (205) the coil winding has a clockwise sense as you travel from position (201) to position (203). As the bullet system which is moving from left to right in FIG. 24 strikes a target the Hammer will be accelerated to the right with respect to the coil and enter the coil at position (207). With the right side of the Hammer being the magnetic north pole of the Hammer magnet the magnetic flux through the coil will be increasing with a sense of left to right in FIG. 24. Faraday's Law will cause an electric field (213) to be created which will have a clockwise sense if you look down the axis of the coil from position (205). The negative of the path integral of the electric field (213) from position (201) to position (203) is equal to the voltage at position (203) minus the voltage at position (201). Since the electric field and the path sense of the integral both have the same direction when looking down the axis of the coil from position (205) the voltage at position (201) will be higher than the voltage at position (203). This is the induced EMF caused from Faraday's Law as the Hammer Magnet moves into the coil. The diode (211) in FIG. 24 allows this EMF to develop because with respect to the induced electric field (213) the diode (211) is forward biased and represents a short circuit across its terminals. The Zener diode (209) in FIG. 24 however is reversed biased with respect to the electric field (213). The Zener diode (209) however will not have any effect because it will be chosen to have a reverse bias breakdown voltage of say 100-200 volts. The voltage developed between position (201) and (203) will be much higher than this Zener breakdown voltage when the Hammer magnet is moving into the coil by virtue of the bullet system hitting a target. Remembering that the voltage induced on impact with a target will be such that the voltage at position (201) will be positive with respect to the voltage at position (203). Thus even though the Zener diode is reversed bias with respect to the Faraday EMF the Zener will have no effect whatsoever because the Faraday EMF will be much higher than the Zener diode reverse bias breakdown voltage and the system will function and there will be spark detonation when the bullet hits a target. What then is the purpose of the Zener diode (209) in FIG. 24? The purpose of the Zener diode (209) in FIG. 24 is significant albeit unobvious. When the bullet is travelling from left to right in FIG. 24 and when the bullet is accelerated from the rifle into the open air of its flight the flux through the coil will be changing with time and Faraday's Law will produce an electric field (213) in FIG. 24. The electric field will have the direction indicated as (213) in FIG. 24. The electric field (213) when the gun is fired and the electric field (213) while the bullet is in flight will be small compared to when the bullet hits its target because the Hammer Magnet is a lot farther away from the coil during takeoff from the rifle and during flight. Even though the electric field (213) will not be zero the Zener diode can be chosen so that the reverse breakdown voltage is greater than any voltage developed between position (201) and position (203) during takeoff from the rifle or during flight. The result is that the Zener diode with its reverse bias will keep an open circuit between position (201) and position (203) during flight takeoff from the rifle and during flight. The result is that during flight takeoff from the rifle and during flight it will be impossible for a voltage to appear between position (201) and position (203) in the circuit of FIG. 24 and early or accidental detonation of the explosive material will be impossible. The presence of the Zener diode (209) will keep an open circuit between position (201) and position (203) during flight takeoff from the rifle and during flight.

CONCLUSIONS RAMIFICATIONS AND SCOPE

The bullet system described is an exploding bullet with internal electromagnetic combustion for detonation. The mechanical motion of the magnet generates a high electrical voltage on the coil by way of electromagnetic induction. The invention is broad with many more permutations than have been discussed and is not to be judged on the specification but rather on the scope of the claims that follow.

What is claimed is:

1. A bullet projectile comprising:

a cylindrical hollow fuselage, a solid cylindrical internal hammer, and a nose cone, wherein said cylindrical hollow fuselage has an inner diameter (ID) an outer diameter (OD) and a length ($L_F$), wherein one end of said cylindrical hollow fuselage is closed and the other end of said cylindrical hollow fuselage is open, wherein said closed end of said cylindrical hollow fuselage faces a back end of said bullet projectile and said open end of said fuselage faces a front end of said bullet projectile, wherein said solid cylindrical internal hammer is positioned inside said cylindrical hollow fuselage, the solid cylindrical hammer having a length ($L_H$) less than the length ($L_F$) and a diameter (D) which is between one mil and ten mils less than the inner diameter (ID), wherein said solid cylindrical internal hammer is free to slide back and forth within said cylindrical hollow fuselage, wherein said solid cylindrical internal hammer is comprised of a material with a permanent magnetic moment, wherein said nose cone is attached to the open end of said fuselage, wherein said nose cone has a base and said base which contacts the front open end of said cylindrical hollow fuselage, wherein a front end of said nose cone defines the front end of said bullet projectile, wherein a volume of internal space is defined between a front end of said solid cylindrical internal hammer and the base of said nose cone when said solid cylindrical internal hammer is positioned to be touching the closed end of said cylindrical hollow fuselage, wherein an explosive material is positioned within said volume of internal space, wherein said cylindrical hollow fuselage comprises solid walls having a wire forming a cylindrical coil positioned therein, wherein two ends of said wire terminate within said explosive material, and wherein said solid cylindrical internal hammer is forced to slide to the rear of said bullet when said bullet projectile is accelerated from rest from a launching device, and wherein said hammer is forced to slide towards the front of said bullet projectile when said bullet projectile strikes a target and undergoes deceleration, and wherein the sliding of said solid cylindrical internal magnetic hammer through the inside of said cylindrical coil causes a time changing magnetic flux through the coil resulting in a voltage between said two ends of wire, and wherein said voltage between said two ends of said wire which are embedded in said explosive material provides a spark discharge serving as a spark detonator to said explosive material, wherein said explosive material and said bullet projectile explodes upon impact with a target.

2. The bullet projectile of claim 1, wherein said open end of said cylindrical hollow fuselage is closed by said nose cone.

3. The bullet projectile of claim 1, wherein said cylindrical hollow fuselage is made of a material with a Young's modulus between 190 Gpa and 440 Gpa.

4. The bullet projectile of claim 1, wherein said solid cylindrical internal hammer material further comprises a metal selected from the group consisting of Lead, Uranium, Tungsten, Gold, Platinum, Mercury, or Iridium.

5. The bullet projectile of claim 1, wherein said fuselage is made of ceramic and said nose cone is made of copper.

6. The bullet projectile of claim 1, wherein the front end of said nose cone is pointed.

7. The bullet projectile of claim 1, wherein the front end of said nose cone is rounded.

8. The bullet projectile of claim 1, wherein the front end of said nose cone is flat.

9. The bullet projectile of claim 1, wherein said nose cone is a compound structure consisting of a rounded flat base atop which sits a pointed cone.

10. The bullet projectile of claim 1, further including a second cylindrical hollow fuselage surrounding said cylindrical hollow fuselage, said second cylindrical hollow fuselage serving to prevent plastic deformation of said cylindrical hollow fuselage.

11. The bullet projectile of claim 1, further including a second cylindrical hollow fuselage surrounding said cylindrical hollow fuselage, said second cylindrical hollow fuselage serving to prevent any plastic deformation of said cylindrical hollow fuselage which might impede the motion and action of said hammer upon impact, wherein a rear end of said second cylindrical hollow fuselage has a diameter greater than a diameter of a front end of said second cylindrical hollow fuselage.

12. The bullet projectile of claim 1, wherein said volume of internal space further includes a plurality of objects composed of material which is not explosive wherein said objects are three dimensional and their largest dimension is less than one tenth of the size of said inner diameter (ID).

13. The bullet projectile of claim 1, wherein the wire forms a helical circular coil and when said solid cylindrical internal hammer moves through said coil in a direction from the rear end of said bullet projectile towards the front end of said bullet projectile an electric field is generated in the wire, the electric field tangent to geometric circles formed by the helical geometric path of said wire, said electric field serving to push a current in the wire in a predetermined direction, wherein said wire comprises a diode, wherein the bias of said diode allows current to flow in said predetermined direction.

14. The bullet of claim 1, wherein said cylindrical hollow fuselage is made of a material with a hardness between 1.8 and 50 Gpa.

15. The bullet projectile of claim 1, wherein the wire forms a helical circular coil and when said solid cylindrical internal hammer moves through said coil in a direction from the rear end of said bullet projectile towards the front end of said bullet projectile an electric field is generated in the wire, the electric field tangent to geometric circles formed by the helical geometric path of said wire, said electric field serving to push a current in the wire in a predetermined direction, wherein said wire further includes a diode, wherein the bias of said diode allows current to flow in said predetermined direction, wherein said wire further comprises a Zener diode having a forward bias direction, said Zener diode oriented so that the forward bias direction is opposite said predetermined direction.

* * * * *